US009558645B2

(12) United States Patent
Layson

(10) Patent No.: US 9,558,645 B2
(45) Date of Patent: Jan. 31, 2017

(54) RELEASED OFFENDER GEOSPATIAL LOCATION INFORMATION TREND ANALYSIS

(71) Applicant: 3M INNOVATIVE PROPERTIES COMPANY, St. Paul, MN (US)

(72) Inventor: Hoyt M. Layson, Orlando, FL (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 14/370,283

(22) PCT Filed: Jan. 4, 2013

(86) PCT No.: PCT/US2013/020242

§ 371 (c)(1),
(2) Date: Jul. 2, 2014

(87) PCT Pub. No.: WO2013/103782

PCT Pub. Date: Jul. 11, 2013

(65) Prior Publication Data

US 2014/0361899 A1 Dec. 11, 2014

Related U.S. Application Data

(60) Provisional application No. 61/584,091, filed on Jan. 6, 2012.

(51) Int. Cl.
*G08B 23/00* (2006.01)
*G08B 21/22* (2006.01)
(Continued)

(52) U.S. Cl.
CPC ..... *G08B 21/18* (2013.01); *G08B 21/0453* (2013.01)

(58) Field of Classification Search
CPC ..... G08B 23/00
See application file for complete search history.

(56) References Cited

U.S. PATENT DOCUMENTS 6,031,460 A 2/2000 Banks
6,054,928 A * 4/2000 Lemelson et al. ..... 340/573.4
(Continued)

FOREIGN PATENT DOCUMENTS

WO WO 2008-027948 3/2008
WO WO 2013-103776 7/2013
WO WO 2013-103779 7/2013

OTHER PUBLICATIONS

International Search Report for PCT International Application No. PCT/US2013/020242, mailed on Apr. 4, 2013, 3 pages.

*Primary Examiner* — Jennifer Mehmood
*Assistant Examiner* — Pameshanand Mahase

(57) ABSTRACT

Methods of trend analysis for information related to released criminal offenders, the methods include accessing geospatial location information including date and time information for released criminal offenders and identifying repeated visits by one of the released criminal offenders within a defined proximity of a particular geospatial location, identifying a movement pattern of one of the released criminal offenders, correlating the movements of one the released criminal offenders to the movements of a subscriber, correlating the proximity of one of the released criminal offenders to a location where criminal activity has occurred, or comparing the geospatial location with previous activity of the released offender to predict potential future criminal activity.

11 Claims, 6 Drawing Sheets

(51) Int. Cl.
*G08B 21/18* (2006.01)
*G08B 21/04* (2006.01)

(56) References Cited

U.S. PATENT DOCUMENTS

| | | | | |
|---|---|---|---|---|
| 6,362,778 | B2 * | 3/2002 | Neher | 342/357.75 |
| 7,162,237 | B1 | 1/2007 | Silver | |
| 7,289,031 | B1 * | 10/2007 | Hock | 340/573.4 |
| 7,298,835 | B1 | 11/2007 | Perry | |
| 7,561,065 | B2 | 7/2009 | Obradovich | |
| 7,565,157 | B1 | 7/2009 | Ortega | |
| 7,577,666 | B2 | 8/2009 | Overton | |
| 7,589,628 | B1 | 9/2009 | Brady, Jr. | |
| 7,598,855 | B2 | 10/2009 | Scalisi | |
| 7,599,795 | B1 | 10/2009 | Blumberg | |
| 7,602,277 | B1 | 10/2009 | Daly | |
| 7,611,409 | B2 | 11/2009 | Muir | |
| 7,616,942 | B2 | 11/2009 | Karl | |
| 7,619,533 | B2 | 11/2009 | Crucilla | |
| 7,646,296 | B2 | 1/2010 | Ohki | |
| 7,647,022 | B2 | 1/2010 | Ng | |
| 7,647,047 | B2 | 1/2010 | Moghaddam | |
| 7,936,262 | B2 | 5/2011 | Derrick | |
| 7,961,092 | B2 | 6/2011 | Freathy | |
| 8,009,036 | B2 | 8/2011 | Freathy | |
| 8,169,316 | B2 | 5/2012 | Freathy | |
| 2002/0164979 | A1 | 11/2002 | Mooney | |
| 2004/0113772 | A1 | 6/2004 | Hong Chou | |
| 2005/0232249 | A1 | 10/2005 | Mishra | |
| 2005/0285747 | A1 | 12/2005 | Kozlay | |
| 2006/0183486 | A1 | 8/2006 | Mullen | |
| 2007/0126573 | A1 * | 6/2007 | Valania | 340/539.13 |
| 2007/0159343 | A1 * | 7/2007 | Crucilla | 340/573.4 |
| 2007/0182544 | A1 | 8/2007 | Benson | |
| 2008/0103293 | A1 | 5/2008 | Cho | |
| 2008/0215627 | A1 | 9/2008 | Higgins | |
| 2010/0317317 | A1 | 12/2010 | Maier | |
| 2011/0201274 | A1 | 8/2011 | Freathy | |
| 2011/0248853 | A1 | 10/2011 | Roper | |
| 2014/0279767 | A1 * | 9/2014 | Torgersrud | G06N 5/02 706/14 |

* cited by examiner

RELEASED OFFENDER GEOSPATIAL LOCATION INFORMATION TREND ANALYSIS

TECHNICAL FIELD

This disclosure relates to trend analysis geospatial location information, including date and time information, related to released criminal offenders.

BACKGROUND

Today, released criminal offenders on community supervision, either probation or parole, are monitored by a criminal justice supervising agency, such as a department of corrections or local law enforcement. The monitoring is based on a sentence, and often includes exclusion areas and inclusion areas with a schedule for the day of the week and a range of times associated with those areas when the released criminal offender is required to be or required not to be in those areas. A released criminal offender's geospatial location at a given date and time is monitored and recorded by tracking devices worn by the released criminal offender. This geospatial information, including date and time information, can be used to determine a released criminal offender's compliance with their sentence. Activities of released criminal offenders can be reported to the criminal justice supervising agency or to a probation or parole officer by fax, page, text message or email generated by a monitoring center unique to the criminal justice supervising agency.

Currently, an offender's geospatial location and associated date and time information can be determined by a number of different methods. These methods range from: (1) voice verification whereby an offender calls in by land line to verify his current geospatial location at a given date and time by using caller ID for a wired line phone, (2) radio frequency monitoring whereby the supervised released criminal offender wears a tamper resistant tag that communicates with receivers at a known geospatial location or geospatial locations using short range (i.e. in the range of 100 meters) radio frequency communications, to (3) tamper resistant tracking devices that record or report geospatial location points along with date and time information either in a batch mode or real time mode using a geospatial location, date and time means such as GPS, cellular triangulation, IP (Internet Protocol) address and/or a wired telephone land line caller ID for batch mode, or wireless communications for both real time and batch modes.

Just as multiple systems are used to determine a released criminal offender's geospatial location at a given date and time, multiple databases exist containing released criminal offender geospatial location information along with date and time information. These databases are owned or operated by contracted companies providing released criminal offender monitoring products and services. Or the criminal justice supervising agency may deploy and operate released offender monitoring and reporting devices produced by vendors. These databases are disparate in terms of their physical location, operation and reporting mechanisms. These databases are heterogeneous in terms of data format since there is no formatting standard for the data collected or stored for supervised released criminal offenders, and there are multiple vendors providing products and services to monitor or locate supervised released criminal offenders. Within a single jurisdiction as small as a city or county, there may be one or more of each type of system described above, each with their own separate unique databases and unique reporting implementations. Disparate systems also do not share geospatial location information along with date and time information with each other. A system which reports supervised released criminal offender's geospatial location, date, and time information and movement history to only one of multiple agencies that may benefit from or need such information is known in the art as a stovepipe system. Further, existing databases track historical geospatial information, including date and time information, related to released offenders. While these databases provide information regarding where an offender has been or what a released offender may have done, they do not provide information predicting future movement and/or action of a released offender, and therefore are not useful in predicting or identifying high risk of crime so that it cart be prevented. There exists a need for an improved method of monitoring released criminal offenders.

SUMMARY

Stovepipe systems of the status quo can be limiting when sentences for supervised released criminal offenders are general guidelines that are wide in their scope and cross over into adjacent criminal justice supervising agencies territories or jurisdictions. This wide scope and geographic range makes it extremely difficult to detect a violation of the supervised released criminal offender's sentence outside of the supervising agency's jurisdiction, much less enforce the sentence.

As an example, supervised released criminal offenders are often not allowed to be with or within a defined proximity of other supervised released criminal offenders. This sentence only be can be monitored and enforced if geospatial location information along with date and time information for two or more supervised released criminal offenders is collected and managed by a single system, so that the system can correlate the locations of the two released criminal offenders at any time, whether in real time or post mortem. This sentence cannot be monitored and is not enforceable if two or more supervised released criminal offenders who come into contact with each other being monitored by different or disparate systems that do not share geospatial location and date and time information about each of the released criminal offenders with each other. A central repository, or clearinghouse, or central repository of supervised released criminal offender geospatial location, date and time data is required to monitor and enforce this particular type of sentence and other sentences that include multiple areas monitored by disparate systems.

Another example relates to predatory offenders such as stalkers, rapists and pedophiles that stalk their victims in order to determine the optimum time and location to perform their predatory crime. Because these supervised released criminal offenders have had and may have sentences preventing association with particular individuals who are potential victims, it is currently impossible to define all possible off limit locations for such a sentence. It is even more impossible to monitor and enforce all locations since the off limit locations are enormous in number and the off limit areas are both static and dynamic. For example, a common sentence for pedophiles is that they are not allowed to loiter or sometimes go to locations where children are present or congregate. Knowing the location of the potential victims in this example is required to assure violation detection and enforcement of such a sentence. Currently, only generally known static locations such as schools and playgrounds can be identified, monitored and enforced as exclusion areas for pedophiles. Dynamic areas such as school bus stops cannot be programmed into monitoring systems and devices for supervised released criminal offender because they change each school year.

Yet another example is based on the recidivism rate among supervised released criminal offenders. Recidivism for this population can be over 60% within two years. Supervised released criminal offenders tend to repeat criminal offenses for which they were previously convicted. Supervised released criminal offenders typically learn surveillance techniques from other inmates to reduce their risk of being apprehended. These surveillance techniques often involve frequent loitering at potential crime opportunity site to determine the best time to commit the crime. It may also involve other supervised released criminal offenders working together as a team.

The result of the disparate systems, the lack of data formatting standards, fragmented reporting and the dynamics of victim and crime opportunity scenarios combine to result in an increased risk to public safety. Further, dynamic exclusion locations and the plurality of static exclusion locations that are unknown to criminal justice supervising agencies make it difficult to effectively monitor supervised released criminal offenders or enforce sentences.

The present invention provides many advantages over the status quo to address many of the limitations of the status quo addressed above. These advantages include data fusion for the supervising authorities of supervised released criminal offenders under community supervision. The present invention allows collection of geospatial location information, including date and time information, from subscribers to identify dynamic exclusion areas for supervised released criminal offenders. The present invention combines these elements to allow the clearinghouse to perform trend analysis based on clearinghouse data or information provided by subscribers.

Additionally, the clearinghouse utilizes a heretofore unavailable method to obtain the date stamped and time stamped geospatial location data of the subscriber who is either a victim or a potential victim to: (1) better monitor and enforce criminal justice sentencing guidelines, (2) better perform trend analysis for predicting criminal activity, and (3) utilize heretofore unavailable increased observation data from subscribers for preventing criminal activity.

Each of these advantages can result in improving public safety by the following items: (1) notifying subscribers (potential victims) to the clearinghouse of the proximity of supervised released criminal offenders, (2) submitting proximity intelligence reports to the criminal justice supervising agency, (3) performing trend analysis and generating potential criminal activity intelligence reports to the criminal justice supervising agency, (4) dispatching law enforcement to apprehend and detain supervised released criminal offenders identified as a threat by potentially stalking victims or surveying criminal opportunities and (5) dynamically establishing new off limit locations for sentencing guidelines further restricting supervised released criminal offenders from non compliance regarding sentencing guidelines, increasing the scope of monitoring and increasing the scope of enforcement.

The present disclosure includes in one instance, a method of trend analysis for information related to released criminal offenders. The method includes: (a) accessing geospatial location information including date and time information for released criminal offenders; and (b) identifying repeated visits by one of the released criminal offenders within a defined proximity of a particular geospatial location.

The present disclosure includes in a second instance, a method of trend analysis for information related to released criminal offenders. The method includes: (a) accessing geospatial location information including date and time information for released criminal offenders; and (b) identifying a movement pattern of one of the released criminal offenders.

The present disclosure includes in a third instance, a method of trend analysis for information related to released criminal offenders. The method includes: (a) accessing geospatial location information including date and time information for released criminal offenders; and (b) correlating the movements of one the released criminal offenders to the movements of the subscriber.

The present disclosure includes in a fourth instance, a method of trend analysis for information related to released criminal offenders. The method includes: (a) accessing geospatial location information including date and time information for released criminal offenders; and (b) correlating the proximity of one of the released criminal offenders to a location where criminal activity has occurred.

The present disclosure includes in a fifth instance, a method of trend analysis for information related to released criminal offenders. The method includes: (a) accessing geospatial location information including date and time information for released criminal offenders; and (b) comparing the geospatial location with previous activity of the released offender to predict potential future criminal activity.

Any of the methods above can further include: reporting the trend analysis to a supervising agency.

Any of the methods above can further include: making results of the trend analysis available to a subscriber.

Any of the methods above can further include: notifying the subscriber within a defined proximity of the released offender based on results of the trend analysis.

Any of the methods above can further include trend analysis performed based on a request by the subscriber.

Any of the methods above can further include: identifying when the released offender is within a defined proximity of a second released offender.

Any of the methods above can further include: comparing information about a location surrounding the released criminal offender to information related to previous criminal activity.

Any of the methods above can further include: predicting an event related to criminal activity, the predicting based on a previous step.

Any of the methods above can further include: notifying a criminal justice agency of the results of the trend analysis.

BRIEF DESCRIPTION OF DRAWINGS

For a more complete understanding of the present disclosure and its advantages, reference is now made to the following description, taken in conjunction with the accompanying drawings, in which.

The accompanying drawings illustrate various embodiments of the present invention. The embodiments may be utilized, and structural changes may be made, without departing from the scope of the present invention. The figures are not necessarily to scale. Like numbers used in the figures generally refer to like components. However, the use of a number to refer to a component in a given figure is not intended to limit the component in another figure labeled with the same number.

DETAILED DESCRIPTION

Figure 1:
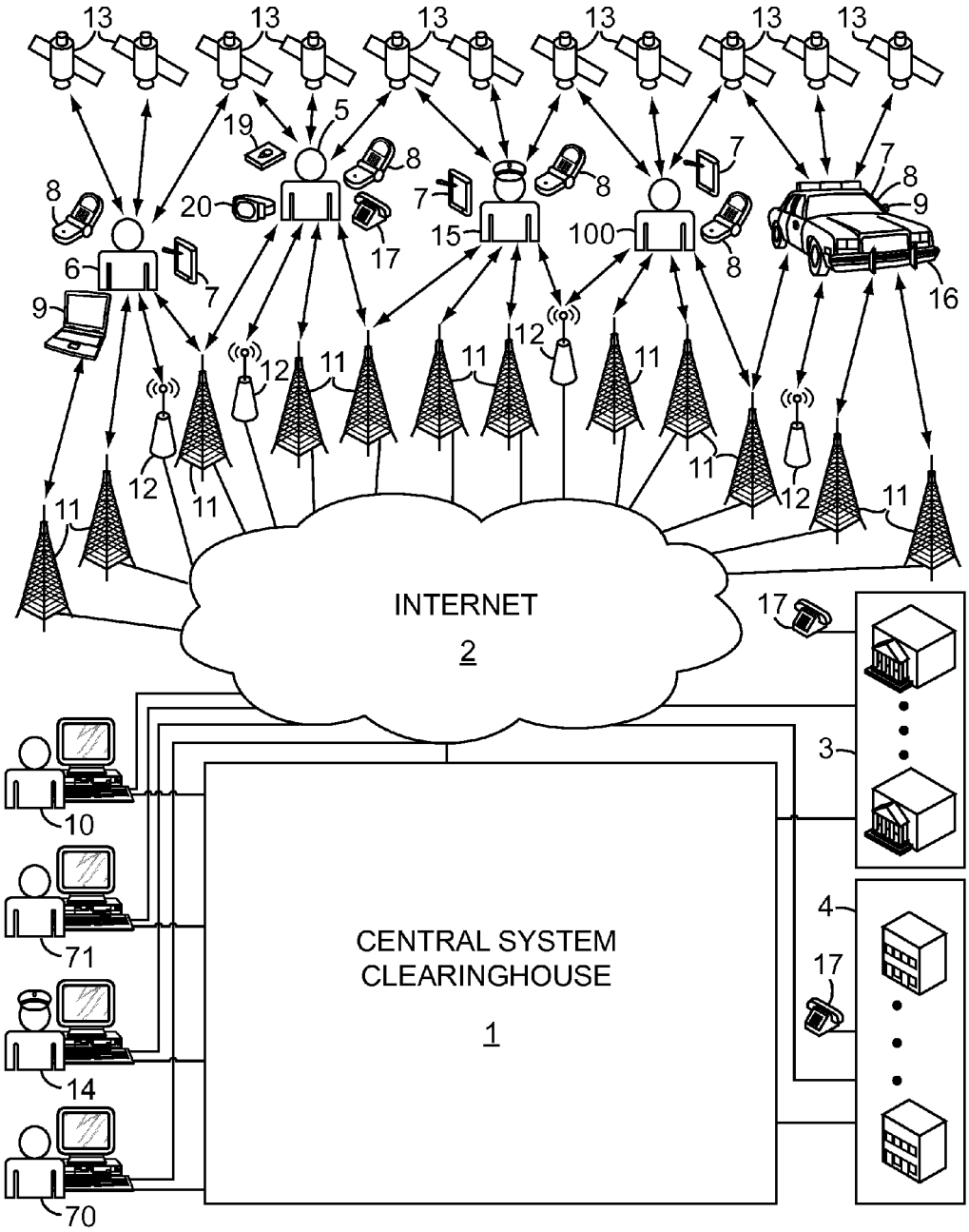
FIG. 1 is a diagram illustrating an exemplary end to end system, including a clearinghouse interfaced to different types of disparate monitoring and data collection systems, and the users of the data produced by the clearinghouse.

FIG. 1 depicts an exemplary end to end system including clearinghouse 1, devices, and people clearinghouse 1 can interface with in such a system. In the illustrated embodiment, clearinghouse 1 is interfaced to people and devices by the internet 2. Further connectivity to the clearinghouse 1 for subscribers 6, probation and parole officers 100 and law enforcement officers 15, 16 using devices 7, 8, 9 is provided by direct connections, wireless cellular 11 or Wifi or WiMax 12 networks using the Internet 2. Direct connections to clearinghouse 1 can be provided for monitoring equipment at supervising agencies 3, monitoring equipment at contracted companies 4, probation and parole officers at supervising agencies 10, law enforcement 14, E911 dispatch 70 and chat operators 71 by connections such as leased lines, x.25, frame relay, etc. Any of the entities above may also be connected to clearinghouse 1 via the internet 2. Any appropriate connection method or protocol for any of the entities or individuals mentioned above may be used in accordance with the scope of the present disclosure.

Currently, criminal justice supervising agencies 3 and contracted companies 4 that monitor a released criminal offender 5 use a variety of tools or devices to determine a released criminal offender's location. Such devices include, for example, land line telephones 17, cellular phones 18, pagers 19, and offender-worn devices 20. These devices use various methods to determine geospatial location at a given date and time. Some devices use wireless 11 triangulation, WiFi 12, IP address, caller ID or satellite 13 triangulation. Some devices are hand carried and some devices are body worn. Some devices provide continuous geospatial location information in real time by using wireless communications while some devices record continuous geospatial information, along with date and time information, and then submit it in a batch mode either wireless or land line communications.

In accordance to the present disclosure, geospatial location information along with date and time information collected by a criminal justice supervising agency 3 or a contracted company 4 are transferred to clearinghouse 1 through the applicable communication link.

Because geospatial location information, along with date and time information, is provided by many different sources, it exists in many heterogeneous formats. When clearinghouse 1 receives the heterogeneous data, a computer system of clearinghouse 1 can convert the data to a homogenous data format. For example, the heterogeneous data can be encapsulated and made homogenous using the capabilities of extended markup language (XML). XML may also be utilized for communication between clearinghouse 1 and systems of criminal justice supervising agencies 3 and contracting companies 4. Any other appropriate method of converting the data to a homogenous format may also be used.

Other entities, such as law enforcement vehicles 16 and officers 15 may have systems for identifying or recording geospatial location along with date and time information systems which can also be interfaced to clearinghouse 1. This allows law enforcement vehicles 16 and officers 15 to be located for supervised released criminal offender 5 apprehension and detention for violations of sentences, panic responses from subscribers 6 and threat warnings generated for subscribers 6.

In the illustrated embodiment, clearinghouse 1 can receive queries from subscriber devices, such as personal digital assistant (PDA) 7, cellular phone 8, laptop computer 9 or other devices that have the ability to provide a location for subscriber 6 as described herein. For example, any of PDA 7, cellular phone 8, laptop computer 9, or other devices with subscriber 6 may have an application that allows the subscriber 6 to send their date stamped and time stamped geospatial location information and demographic data to the clearinghouse 1 either by wireless or wired means. Additional devices that may be used by the subscriber 6 include smart phones, laptop computers and desk top computers, any of which may allow the subscriber 6 to provide location information, along with date and time information to clearinghouse 1. These devices may communicate with clearinghouse 1, for example, through a Local Area Network (LAN), Integrated Services Digital Network (ISDN), cable or telephone modem. Geospatial location of the subscriber 6 along with date and time information can either be sent as a result of the subscriber query or can be sent continuously by an application in the subscriber's 6 wireless device or by any device that can be attached by wired network or phone line. The geospatial location along with date and time information of the subscriber 6 can be determined by the subscriber's 6 device using GPS, cellular triangulation or other geospatial location, date and time locating methods. Wired or wireless networks 11 can also provide the geospatial location information, along with date and time information of the subscriber's device.

A subscriber 6 can be any individual or entity who is not a supervised released criminal offender. This can include past victims, potential victims, law enforcement personnel and others. Subscribers 6 can also have different levels of interaction with clearinghouse 1. For example, subscribers 6 may be an active part of the clearinghouse 1 system. A subscriber 6 may have a device that regularly interacts with clearinghouse 1 by regularly sending location information to clearinghouse 1 so that clearinghouse 1 actively tracks subscriber 6. Subscriber 6 can receive automated push notifications based on particular criteria, subscriber preferences, released criminal offender trend analysis and released criminal offender threat assessment. For example, a subscriber 6 may receive a push notification when subscriber 6 is within a given, predetermined distance of a released criminal offender 5. On the other hand, a subscriber 6 may also interact with the clearinghouse 1 only on a demand or passive basis. Such a subscriber 6 is a recipient. A recipient typically plays a more passive role when interacting with clearinghouse 1. A recipient may use a device to make queries to the clearinghouse and is able to submit further information related to a released criminal offender 5 identified by the clearinghouse in a response to the recipient's query. The recipient may also provide location information to clearinghouse 1. In some cases, based on released criminal offender 5 trend analysis and thread assessment, clearinghouse 1 may push a notification to a recipient based on the recipient's cumulative queries demonstrating a trend or threat level assessment by a released criminal offender, but clearinghouse 1 will typically not actively track the location of a recipient. There can be other types of subscribers 6 with varying ranges of interaction with clearinghouse 1, but the term subscriber 6 is used generically to describe these individuals.

An application on the subscriber's 6 mobile or wireless device can allow the subscriber 6 to provide additional information, such as narrative information, about the subscriber's 6 current geospatial at a given date and time. For example, a school bus stop or a place where children gather are typically off limits for pedophiles. Such locations tend to be dynamic over time such that they are unknown to supervising agencies 10 when those agencies establish off limit areas or exclusion zones in the monitoring systems of a criminal justice supervising agency 3 or contracted company 4 and offender monitoring devices such as land line telephones 17, cellular phones 18, pagers 19, and offender-worn devices 20. By receiving such information from subscribers 6, supervising agencies 10 can dynamically update off limit areas or exclusion zones for pedophiles in either the criminal justice supervising agency 3 or contracted company 4 systems and/or clearinghouse 1. Further, by allowing subscribers 6 to enter dynamic locations with a narrative description, and submit the information to supervising agencies 10 via the clearinghouse 1, the supervising agency 10 can evaluate these locations and better monitor and enforce sentences. The supervising agency can continuously update off limit areas in criminal justice supervising agency 3 or contracted company 4 monitoring systems and in the supervised released criminal offender's devices.

Subscriber 6 can then be notified if there is a released criminal offender 5 within a predefined proximity or distance range and time interval entered by the subscriber 6. Subscriber 6 can receive such a notification in a timely fashion for those supervised released criminal offenders 5 that have continuous wireless reporting devices. For supervised released criminal offenders 5 with batch reporting devices, a message either by text or email can be sent to the subscriber 6 as soon as the date stamped and time stamped geospatial location information for a released criminal offender 5 matching the subscriber's 6 prior query is subsequently identified by the clearinghouse 1 when the supervised released criminal offender's 5 data arrives at clearinghouse 1. Whenever the clearinghouse 1 notifies the subscriber 6 through a report, clearinghouse 1 can also report the same, less, or more extensive information to the supervising agency 10. Clearinghouse 1 can also log the occurrence(s) in a data base of clearinghouse 1 with an incident identifier for ongoing or subsequent trend analysis and evaluation by the criminal justice supervising agency 10, clearinghouse 1, or any other appropriate entity with access to the necessary data, such as incident identifiers.

An application consistent with the present disclosure can be on any device including a processor, display and communication capabilities, including each of subscriber 6 devices described above. The application can be configured to interface with a clearinghouse 1 consistent with the present disclosure, where the clearinghouse 1 integrates geospatial information, including date and time information related to released criminal offenders.

The application may have multiple user interfaces, which the interfaces are displayed on a device display, where the interface varies depending upon the user accessing the application. For example, the application may have an interface tailored to law enforcement, where the interface allows the user to submit a query regarding current location of a released offender, previous violations of a released offender, movement history of a released offender, and any other particular information a law enforcement agency may require access to.

The user interface may also be configured as the subscriber interface, where the subscriber 6 is either a victim or potential victim. In such configurations, the application may further interface with an emergency dispatch center, such as an E911 center, so that if the subscriber 6 becomes aware of a dangerous situation due to the proximity of a released offender, they can use the application to contact emergency assistance. Further, the user interface may also allow a user to communicate with a live chat operator.

The user interface may have features that allow the subscriber to request and receive regular updates or notifications from the clearinghouse. The updates or notifications can be based on proximity of the user to a released offender, or on any other appropriate parameters. The user can submit a general query to the clearinghouse based on the location of the user. More specific functionalities of a user interface are described below with respect to FIGS. 3 and 4.

In one embodiment, when clearinghouse 1 identifies a trend of stalking behavior by a released criminal offender 5, clearinghouse 1 may report the trend or a potential violation to subscriber 6, criminal justice supervising agency 10, probation and parole officers 100 and/or law enforcement 14. Either the criminal justice supervising agency 10, probation and parole officers 100, law enforcement 14 or clearinghouse 1 can send information to law enforcement officers 15 or law enforcement vehicles 16 near the current geospatial location of subscriber 6. The information can also be sent to live chat operators 71 and E911 dispatch 70. Law enforcement vehicles 16 may have one or more wireless devices which clearinghouse 1 can use for collecting law enforcement officer 15 or vehicle 16 geospatial location information, including date and time information, and for sending information. Clearinghouse 1 also sends a warning to a wired or wireless device with the subscriber 6. Subscriber 6 can also subscribe to continuous updates and be notified whenever a released criminal offender 5 is in the area or within a predefined proximity of subscriber 6.

Figure 2:
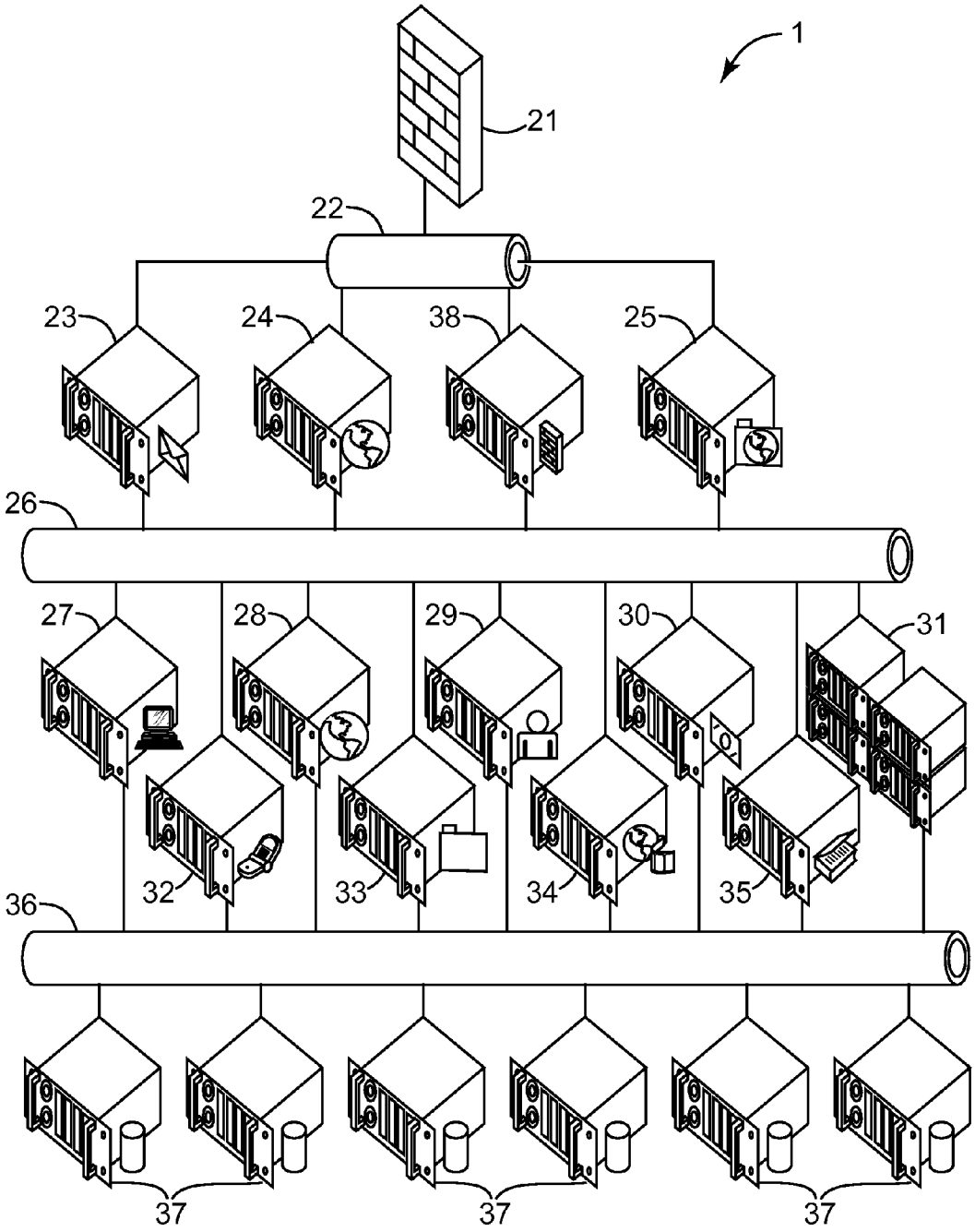
FIG. 2 is a diagram illustrating an exemplary computer architecture for a clearinghouse.

FIG. 2 depicts an exemplary computer architecture for a clearinghouse including a detailed architecture of tiered service components in a traditional Service Oriented Architecture (SOA) implementing end to end transactions as threads of services. While FIG. 2 shows a particular configuration for server architecture, any appropriate configuration consistent with the scope of the present disclosure can be used to construct a server architecture for clearinghouse 1. In the illustrated embodiment, clearinghouse 1 provides Software as a Service (SaaS) as known in the art for cloud computing. Although FIG. 2 depicts all of the server components in one location, the architecture can be distributed, clustered and federated across the internet. Distributed server architectures provide availability should a portion of the internet or a server location suffer congestion or an infrastructure outage. Clustered server architectures can provide availability, manageability and scalability. Federated server architectures provide allows processing load to be shared and partitioned amongst multiple servers thereby increasing throughput. Therefore the distributed, clustered and federated architecture of the clearinghouse SOA architecture disclosed herein provides the advantages of being scalable, reliable and high performance.

In the illustrated embodiment, the top tier of the clearinghouse 1 architecture interfaces with internet 2 via firewalls 21. Firewalls 21 can be configured in any arrangement known in the art of internet based information processing and e-commerce. Firewalls 21 protect the clearinghouse 1 from such things as denial of service attacks, unauthorized user access and the infusion or injection of viruses as known in the art into the operating systems and applications executing in/on servers behind the firewalls 21.

The first tier sub-network 22 interfaces the servers that provide standard Internet services such as e-mail, websites, device communication gateways and file transfer protocol (FTP). The e-mail servers 23 can provide email services to a variety of entities, including subscribers 6, supervising agencies 10, probation and parole officers 100, law enforcement officers 14, 15 and vehicles 16, E911 dispatch 70, live chat operators 71, e-commerce servers 30 and the application servers 31. Web servers 24 can host the web services that provide the browser services between the application servers 31 and the other components or users of an end to end system such as subscribers 6, supervising agencies 10, probation and parole officers 100, and law enforcement officers 14, 15 and vehicles 16. The FTP servers 25 can provide file transfer services to subscribers 6, supervising agencies 10, law enforcement officers 14, 15 and vehicles 16, E911 dispatch 70, live chat operators 71 and criminal justice supervising agency 3 and contracted company 4 monitoring systems. The gateway servers 38 can provide the advantages of availability, high throughput and assured delivery of data for subscribers 6, supervising agencies 10, probation and parole officers 100, supervising criminal justice agency 3 and contracted company 4 monitoring systems and law enforcement officers 14,15 and vehicles 16 to and from clearinghouse 1. The gateway servers 38 can provide flow control by sending UDP packets with updated lists of gateway server 38 IP addresses to prevent congestion or to rout around gateway outages.

The $2^{nd}$ tier sub-network 26 interfaces any business logic implemented in servers 27, 28, 29, 30, 31, 32, 33, 34, 35 to the web services on the first tier web servers 23, 24, 38 and 25. Management servers 27 manage resources and monitor and control performance for the business logic tier, especially congestion on the real time gateway servers 38. Geospatial information servers 28 provide translation between coordinates of latitude and longitude, postal address layers, map layers and other feature layers for the business logic tier. Real time communication servers 29 provide the services for chat, text messaging, voice, and graphics for the business logic tier. E-commerce servers 30 provide E-commerce services for subscribers 6 supervising agencies 10, probation and parole officers 100, and law enforcement officers 14, 15 and vehicles 16 regarding accounting for the services provided. Application servers 31 provide a plurality of application services for the clearinghouse 1, subscribers 6, supervising agencies 10, probation and parole officers 100, E911 dispatch 70, operator chat 71 and law enforcement officers 14, 15 and vehicles 16. Application servers 31 provide the custom applications that implement the business logic for the clearinghouse 1. Mobile information servers 32 maintain attribute information specific to portable wireless devices, such as PDA 7, cellular phone 8, and laptop computer 9, and format the data for the wireless devices. File servers 33 maintain the application files that are uploaded and downloaded between the components of the end to end system and provide XML services for data format conversion, encoding and decoding. Streaming media servers 34 deliver image data, streaming audio and streaming video content to portable wireless devices and wired devices with law enforcement officers 14, supervising agencies 10, E911 dispatch 70 and live chat operators 71. Directory servers 35 maintain a directory of components, in the end to end system. Temporary variables and service thread attributes for tier 2 servers can be stored locally on the respective servers, thereby not competing for data base servers 37, and additionally providing a stateless architecture eliminating single points of failure for process threads in the servers of the clearinghouse 1. In the illustrated configuration, this is possible because the SOA transactions are data driven, and data loss is unlikely due to assured delivery end to end by acknowledgements at gateway servers 38 and application servers 31. Therefore any unacknowledged or negatively acknowledged service thread is restarted once the TTL (Time To Live) timeout occurs.

The third tier sub-network 36 interfaces the business logic in the second tier to the clustered and federated database servers 37. The database servers 37 provide the usual and customary functions of storage, retrieval, updating and archiving of all data in the clearinghouse 1.

Exemplary User Interfaces

Figure 3:
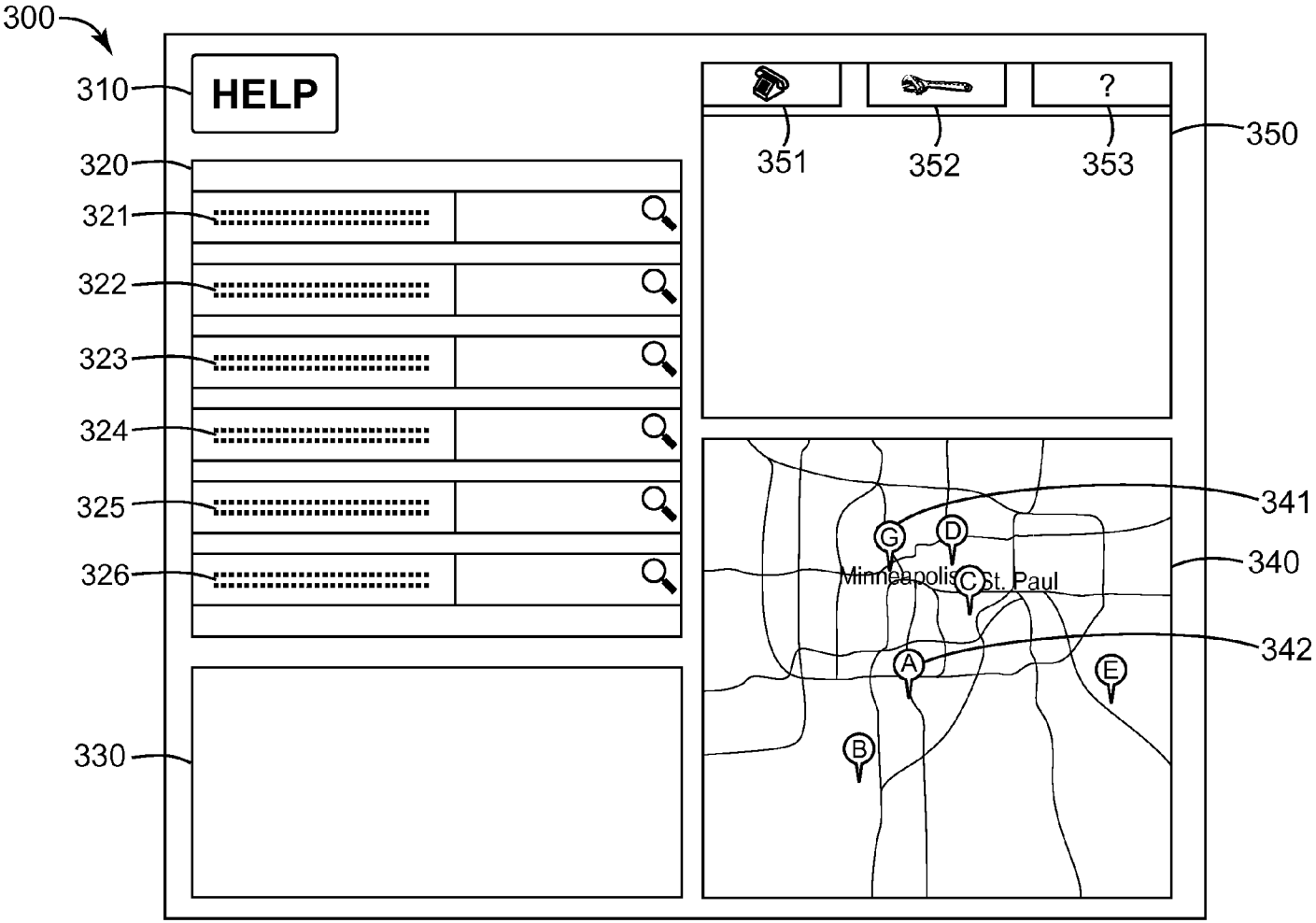
FIG. 3 represents an exemplary subscriber user interface displayed on a subscriber device.
Figure 4:
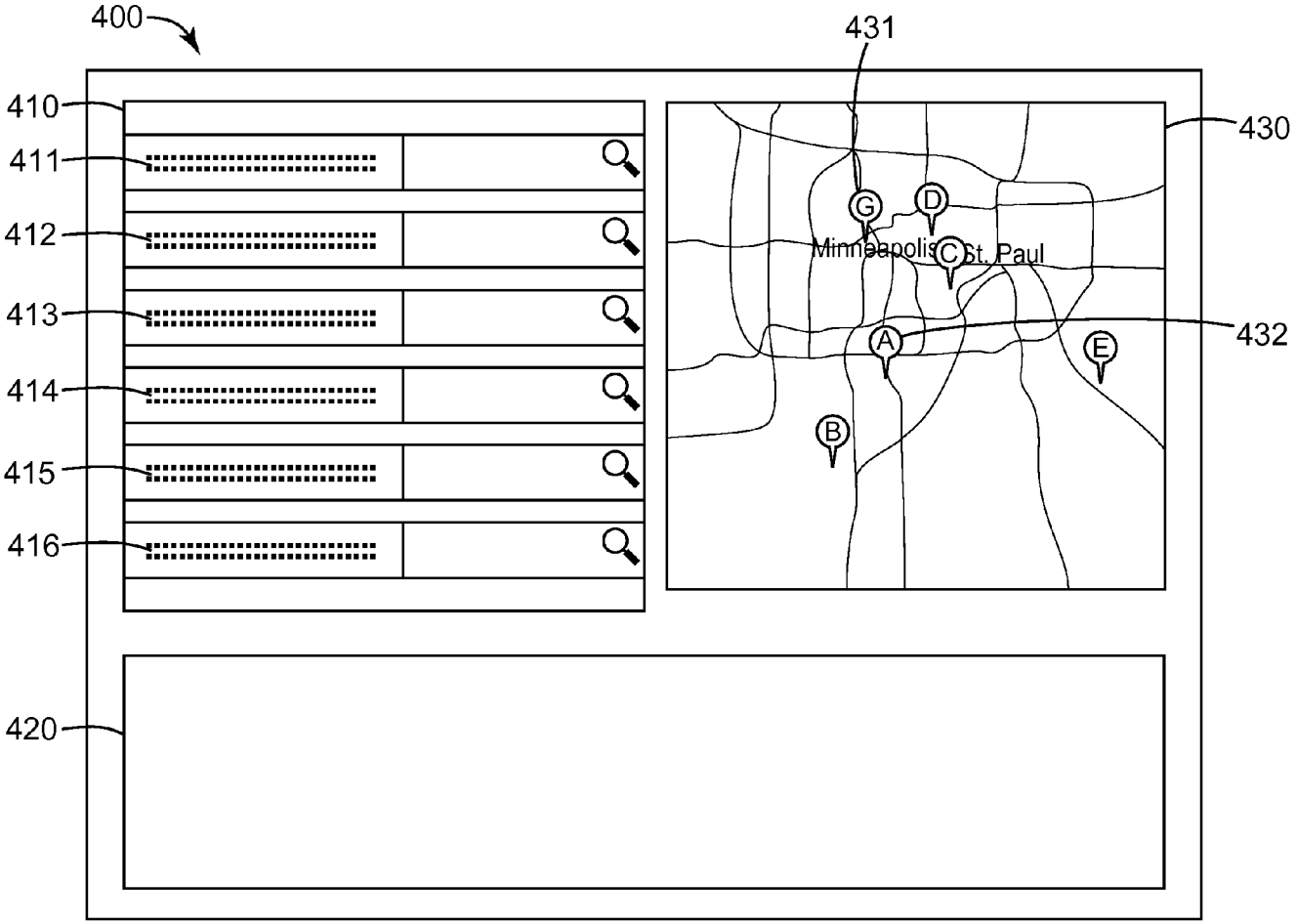
FIG. 4 represents an exemplary law enforcement user interface displayed on a law enforcement device.

FIG. 3 represents an exemplary subscriber 6 user interface 300 displayed on the subscriber device 7, 8, 9. The user interface provides the subscriber 6 or other system user direct interaction with clearinghouse 1 through the various communication pathways as outlined in FIG. 1. The user interface 300 discussed in FIG. 3 is exemplary. A person of skill in the art will recognize layout and design variation such as shifting the position of the overlap map 340, placement of the chat window 350, or user query request fields 321-326. Clearinghouse 1 applications residing on the subscriber device 7, 8, 9 as outlined in FIG. 2 permit customization of the subscriber 6 user interface, and content illustrated in FIG. 3 or not illustrated in FIG. 3 may be added or deleted. While different interfaces are shown in FIGS. 3 and 4, interfaces may be further customized based on the type of subscriber 6 or law enforcement 14, 15 entity. For example, when a subscriber is a recipient, the features available in user interface 300 may be reduced consistent with the level of access or interaction recipient has with clearinghouse 1.

The subscriber 6 user interface 300 includes a panic response or alert button 310, which directly informs Clearinghouse 1 that subscriber 6 or other system user is in need of assistance. When activated, the panic response or alert button 310 notifies the application servers 31 defined in FIG. 2. The panic response or alert button 310 may be activated as a touch icon on a touch screen or through other input devices connected to the subscriber 6 device 7, 8, 9. As an example, the subscriber 6 may use the mouse or a keystroke on a keyboard connected to a laptop computer 9 to initiate the panic response or alert.

A query request window 320 permits text based entry into associated fields on the application running on the subscriber device 7, 8, 9. Queries submitted define how Clearinghouse 1 will interact and respond to the subscriber 6 or other system user. The subscriber 6 may use the query request window 320 to query Clearinghouse 1 to determine the current or past location of an offender 5 in relation to the subscriber 6 current location. The subscriber 6 may query Clearinghouse 1 based on subscriber 6 location 321, offender 5 location 322, offender 5 demographic information 323, offender 5 sentencing guidelines 324, and offender 5 location trend information 325. Fields illustrated in the query request user interface 320 or not illustrated may vary and permutations will be apparent to one of skill in the art. The query request window 320 also includes a field where the subscriber 6 may define notifications and alerts 326 to Clearinghouse 1 and how responses should be received. As an example, the subscriber 6 inputs text into the notification and alert field 326 regarding the distance that an offender 5 should be from subscriber 6 before a notification is sent to the subscriber device 7, 8, 9. For example, subscriber 6 may input that when an offender 5 is less than 50 meters from subscriber 6 clearinghouse 1 should generate an email notification to the subscriber 6.

Responses to user generated queries are displayed in a query response window 330 and/or an overlap map 340 on the user interface 300. Definition as to where a response will be displayed may be defined by the subscriber 6 in the notification and alert 326 field of the query request window 320. In the query response window 330, text based messages will be displayed in response to the subscriber 6 query. As an example, the subscriber 6 inputs their current location as Chile, Wis., into the query request field 321 and executes the search on the application. The subscriber 6 may input their location as a city with a state, a zip code, or as GPS coordinates. Clearinghouse 1 would analyze the location, demographic, sentencing guidelines, and trending information of offenders 5 within a predetermined distance of the subscriber 6 location as defined in FIG. 5. Clearinghouse 1 then transmits the information resulting from the query to the subscriber device 7, 8, 9 and the information will be displayed in the query response window 330. Information displayed in the query response window may display the name and gender of the released criminal offender 5, along with other information, such as Joe Smith, Male, 70 kg along with sentencing or trend information including a frequency of how often offender 5 has visited their current location. Information displayed in the query response window 330 may also include a picture of the released criminal offender 5. As an example, trend information may be displayed in the query response window that Joe Smith has frequented his current location in Chile, Wis., three times per day since the first of the month. Clearinghouse 1 responses may also be presented in graphical format as shown in an overlap map 340. Icons 341 representative of subscriber 6 and offender 5 or other systems users will be displayed in the overlap map 340. Additional information about the subscriber 6 or offender 5 will be displayed in call out window 342 when the subscriber 6 selects or moves over the icon 341 on the overlap map 340. Representation of icons and call out windows are exemplary in the user interface 300 and may assume the shapes of numerous symbols or banners. Variations on the design will be apparent to one of skill in the art upon reading the present disclosure.

The subscriber 6 chat window 350 is also included on the subscriber 6 user interface 300. The chat window 350 enables real-time messaging communication with another system user and more critically E911 Dispatch 70 once activated by the subscriber 6. A connect and disconnect button 351 presented in the chat window 350 will initiate and terminate chat sessions between the subscriber 6 and other system users. Chat window settings can be altered through an options button 352. Chat window settings may include textual alterations or options to select, invite, and add other system users to chat sessions. A help button 353 will also be provided that provides assistance and explanation regarding how the chat window or other user interface windows operate.

Query response window 330 can also be used to display push notifications from the subscriber application. For example, the query response window 330 may display a notification when a designated released criminal offender 5 is within a certain proximity of the subscriber 6. Query response window 330 may also display alerts or other notifications when subscriber is within a certain proximity of a location where criminal activity is predicted. The notification could be shown only at a given time, or at any time where subscriber 6 is within the certain proximity. A certain proximity may be a pre-set proximity by the subscriber 6, by the law enforcement agency 14, 15, or may be determined by an algorithm within the subscriber application.

Representation of icons and call out windows are exemplary in the user interface 300 and may assume the shapes of numerous symbols or banners. Variations on the design will be apparent to one of skill in the art upon reading the present disclosure.

FIG. 4 represents an exemplary law enforcement 14, 15 user interface 400 displayed on a law enforcement device 7, 8, 9. The user interface provides law enforcement personnel 14, 15 or vehicles 16 or other system user direct interaction with clearinghouse 1 through the various communication pathways as outlined in FIG. 1. The user interface discussed in FIG. 4 is exemplary. A person of skill in the art will recognize layout and design variation such as shifting the position of the overlap map, placement of the chat window, or user query request fields. Clearinghouse 1 applications residing on the law enforcement device 7, 8, 9 as outlined in FIG. 2 permit customization of a law enforcement 14, 15 user interface and content illustrated in FIG. 4 or not illustrated in FIG. 4 may be added or deleted.

A query request window 410 on the law enforcement 14, 15 user interface 400 permits text based entry into associated fields on the application running on a law enforcement device 7, 8, 9. Queries define how Clearinghouse 1 will interact and respond to law enforcement 14, 15 or other system users. Law enforcement 14, 15 may use the query request window 410 to query Clearinghouse 1 to determine the current or past location of an offender 5 in relation to the subscriber 6 current location or the location of the requesting law enforcement 14, 15 personnel. Law enforcement 14, 15 may query Clearinghouse 1 based on subscriber 6 location 411, offender 5 location 412, offender 5 demographic information 413, offender 5 sentencing guidelines 414, and offender 5 location trend information 415. Fields illustrated in the query request user interface 410 or not illustrated may vary and permutations will be apparent to one of skill in the art. The query request window 410 also includes a field where law enforcement personnel 14, 15 may define notifications and alerts 416 to Clearinghouse 1 and how responses should be received. As an example, law enforcement 14, 15 inputs text into the notification and alert field 416 regarding the distance that an offender 5 should be from subscriber 6 before a notification is sent to a law enforcement device 7, 8, 9. Law enforcement 14, 15 may input into the notification and alert field 416 that when an offender 5 is less than 50 meters from subscriber 6 clearinghouse 1 should generate an email notification to the law enforcement 14, 15.

Responses to user generated queries are displayed in a query response window 420 and/or an overlap map 430 on the user interface 400. Definition as to where a response will be displayed may be defined by law enforcement personnel in the notification and alert 416 field of the query request window 410. In the query response window 420, text based messages will be displayed in response to the law enforcement 14, 15 personnel query. As an example, law enforcement 14, 15 inputs the subscriber 6 current location as Chile, Wis., into the query request field 411 and executes the search on the application. Law enforcement 14, 15 may input subscriber 6 location as a city with a state, a zip code, or as GPS coordinates. Clearinghouse 1 would analyze the location, demographic, sentencing guidelines, and trending information of offenders 5 within a predetermined distance of the subscriber 6 location as defined in FIG. 5. Clearinghouse 1 then transmits the information to a law enforcement device 7, 8, 9 and the information will be displayed in the query response window 420. Information displayed in the query response window 420 may display the name and gender of the offender 5, such as Joe Smith, Male, 70 kg along with sentencing or trend information including a frequency of how often offender 5 has visited their current location. Query response window 420 may also display a photograph, or any other desired information relating to offender 5. As an example, trend information may be displayed in the query response window that Joe Smith has frequented his current location in Chile, Wis., three times per day since the first of the month. Clearinghouse 1 responses may also be presented in graphical format as shown in an overlap map 430. Icons 431 representative of subscriber 6, offender 5, law enforcement 14, 15 or vehicles 16, or other systems users will be displayed in the overlap map 430. Additional information about the subscriber 6 or offender 5 will be displayed in call out window 432 when law enforcement 14, 15 selects or moves over the icon 431 on the overlap map 430.

Query response window 420 can also be used to display push notifications from the law enforcement 14, 15 application. For example, the query response window 420 may display a notification when a designated released criminal offender 5 is within a certain proximity of a law enforcement 14, 15 officer, vehicle or other location. Query response window 330 may also display alerts or other notifications when a law enforcement 14, 15 officer is within a certain proximity of a location where criminal activity is predicted. The notification could be shown only at a given time, or at any time where law enforcement 14, 15 officer is within the certain proximity. A certain proximity may be a pre-set proximity by the subscriber 6, by the law enforcement agency 14, 15, or may be determined by an algorithm within the subscriber application.

Representation of icons and call out windows are exemplary in the user interface 400 and may assume the shapes of numerous symbols or banners. Variations on the design will be apparent to one of skill in the art upon reading the present disclosure.

Figure 5:
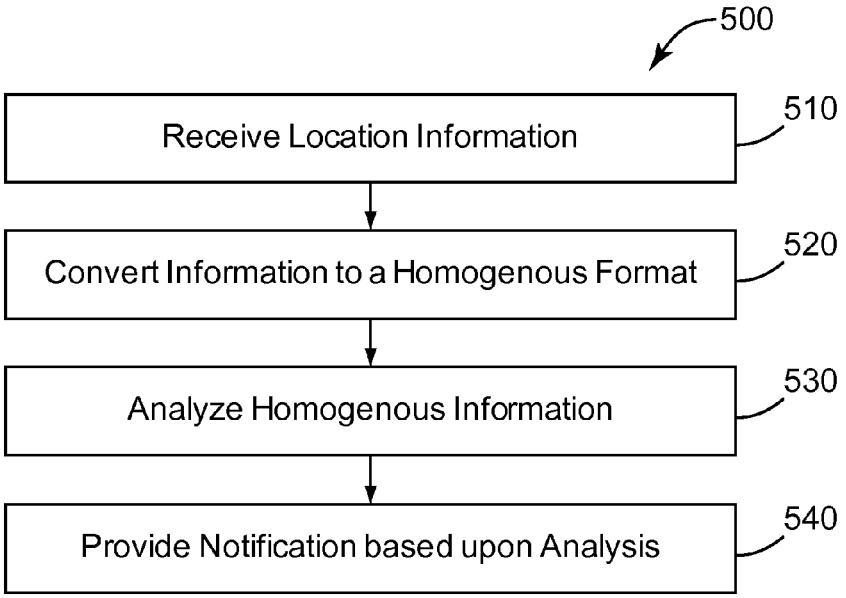
FIG. 5 illustrates an exemplary workflow for a clearinghouse.
Figure 6:
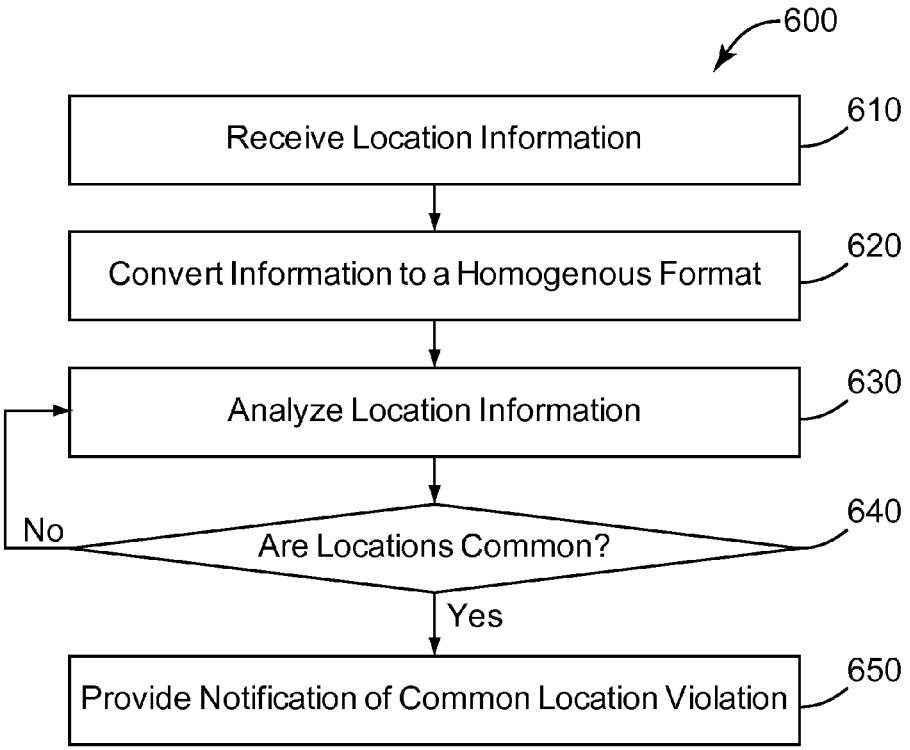
FIG. 6 illustrates an exemplary workflow for offender proximity and trend activity analysis.
Figure 7:
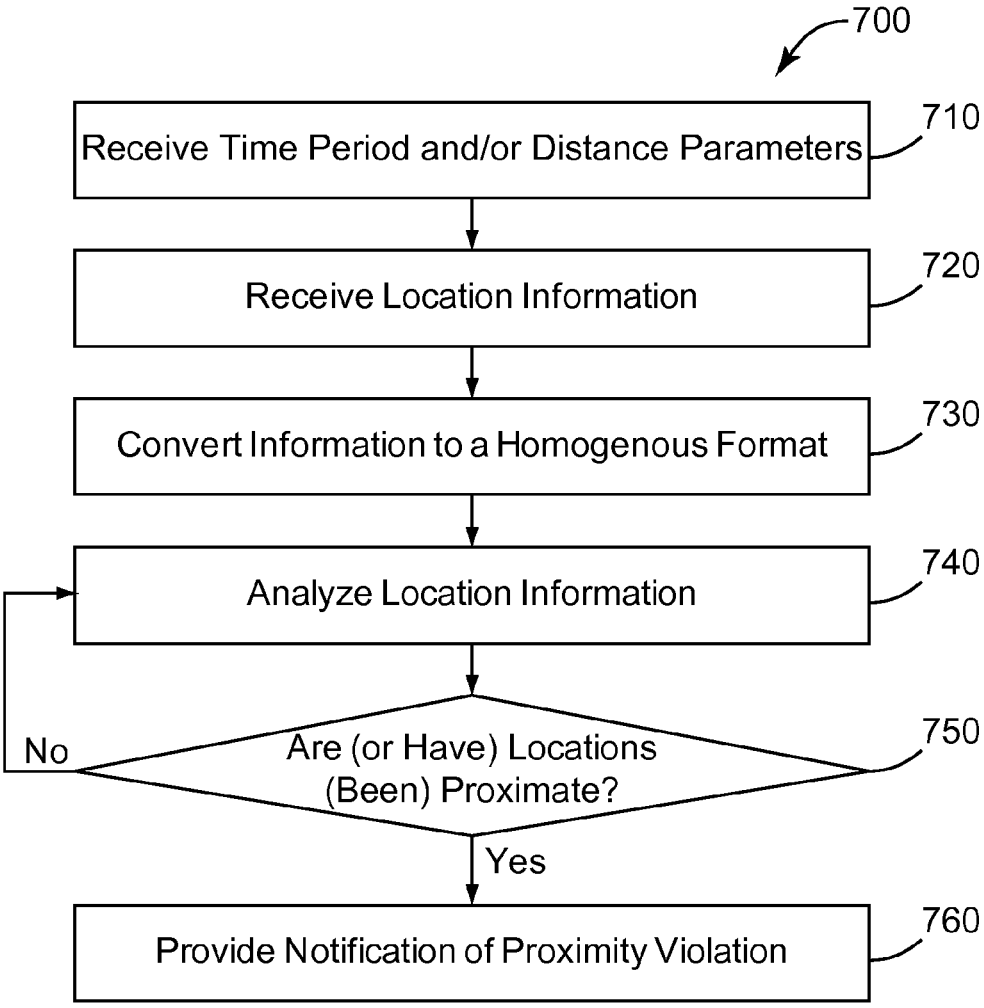
FIG. 7 illustrates an exemplary workflow of offender to subscriber trend activity analysis.

FIGS. 5, 6 and 7 depict various exemplary work flows associated with a clearinghouse consistent with the present disclosure. While the exemplary work flows show particular scenarios and ways in which a clearinghouse can interact with data, individuals, devices, and ways in which the clearinghouse can operate, permutations and variations on these examples will be apparent to one of skill in the art upon reading the present disclosure. The various steps and devices shown in and discussed in the context of each of the Figures can be adapted to meet other particular use cases and work flows. Further, steps and devices shown in the Figures may be combined in variety of ways; the Figures are only intended to illustrate a sampling of the possible processes and communication routes made possible by the present disclosure. Finally, as technology evolves, some of the processes or steps shown in the Figures may become unnecessary or obsolete; however, the scope of the inventive concepts disclosed and claimed herein will still be understood by those of skill in the art.

FIGS. 5, 6 and 7 depict various exemplary work flows associated with a clearinghouse consistent with the present disclosure. While the exemplary work flows show particular scenarios and ways in which a clearinghouse can interact with data, individuals, devices, and ways in which the clearinghouse can operate, permutations and variations on these examples will be apparent to one of skill in the art upon reading the present disclosure. The various steps and devices shown in and discussed in the context of each of the Figures can be adapted to meet other particular use cases and work flows. Further, steps and devices shown in the Figures may be combined in variety of ways; the Figures are only intended to illustrate a sampling of the possible processes and communication routes made possible by the present disclosure. Finally, as technology evolves, some of the processes or steps shown in the Figures may become unnecessary or obsolete; however, the scope of the inventive concepts disclosed and claimed herein will still be understood by those of skill in the art.

Exemplary Work Flows

FIG. 5 represents an exemplary work flow 500 of trend analysis provided by clearinghouse 1 as shown in FIG. 1. The process outlined in FIG. 5 outlines an exemplary path through the tiered, clustered, and federated sub-networks 22, 26, 36 as identified in FIG. 2 in which a clearinghouse interacts with data, individuals, and devices. Permutations on these examples and the incorporation of evolving technology will be apparent to one of skill in the art upon reading the present disclosure. Not all steps may be required and in some instances, additional steps not illustrated in FIG. 5 may be performed by clearinghouse 1. Among other functions, clearinghouse 1 can receive, convert, analyze, store, notify, report, and overlay geospatial location and other defined information including: criminal records, demographic information, and sentence guidelines. Inclusion of other information will be apparent to one of skill in the art.

As shown in step 510 of FIG. 5, clearinghouse 1 first receives offender 5 or other user location information. Other users include, but are not limited to: subscribers 6 and law enforcement personnel 14, 15 and vehicles 16. Such information can be geospatial information also including time and date. Depending on the monitoring device used by the offender 5 or the user providing data to clearinghouse 1, clearinghouse 1 may receive data in different ways. For example, if an offender 5 is wearing a criminal offender tracking device 20 with GPS and communication capabilities, the criminal offender tracking device 20 may be configured to connect directly to the clearinghouse 1. In such a situation, the device may transmit real time or historic geospatial information, including date and time, to the clearinghouse 1 via a wired or wireless connection. If an offender is wearing a criminal offender tracking device 20 with GPS capabilities, but is not connected to the clearinghouse, a supervisory agency 3 or contracted company 4 receiving data including geospatial location information from the criminal offender tracking device may transmit the information to the clearinghouse 1 via a wired or wireless connection. The information may be transmitted as historic or in real time. If an offender 5 or user does not have a tracking device with GPS capabilities, the offender may be required to directly inform a supervising agency 3, contracted company 4, or other user of historic or real time geospatial location information, including date and time information. In that instance, the supervising agency 3, contracted company 4, or other user may then provide such information directly to the clearinghouse 1. System users not wearing tracking devices may directly interact with clearinghouse 1 through the use of cellular phones 8, laptop computers 9, personal digital assistants (PDA) 7, or other personal communication devices.

Supervising agencies 3, contracted companies 4, law enforcement 14, 15, offenders 5, and subscribers 6 interact with clearinghouse 1 to create user interface procedures. User interface requests or procedures indicate how clearinghouse 1 should respond when definition is provided by a supervising agency 3, contracted company 4, law enforcement 14, 15, or subscriber 6. As an example, information may be received from the supervising agency 3, contracted company 4, or law enforcement 14, 15 that clearinghouse 1 should notify the supervising agency 3, contracted company 4, or law enforcement 14, 15 of offender 5 movement and predefined proximity trends to other system users. Clearinghouse 1 may also receive offender 5 violation and sentencing guidelines from supervising agencies 3, contracted companies 4, law enforcement 14, 15 or directly from the offender tracking device 20. The clearinghouse 1 will thus be instructed through user interface requests to analyze trends and the current movement of offender 5 and transmit the information including location to the supervising agencies 3, contracted companies 4, and law enforcement 14, 15. Trend data may be used to predict future offender 5 movements and potential future criminal activity. For example, clearinghouse 1 may be configured to receive offender 5 location information on a continual, time period, basis. The time period is user definable and may be in configured in any combination of days, hours, minutes, and/or seconds. Variation of monitored system user and time period will be apparent to one of skill in the art. Reception of data to clearinghouse 1 may be facilitated via the monitoring of a standard interact service 220 as described in FIG. 2. Subscribers, offenders, or other system users interact with the clearinghouse 1 through standard internet services 220 providing information in various formats (email, telephone, web applications or other file transfer protocols). Received information along with business logic services 230 that manage the standard interact service 220 as defined in FIG. 2 are stored for retrieval, updating, and/or archiving in clearinghouse 1 in clustered and federated database servers 37.

Once clearinghouse 1 receives offender or other user location information as shown in step 510, clearinghouse 1 then converts the received information to a homogenous format as shown in step 520. The process of converting received information into a homogenous format enhances analysis and data comparison as defined in step 530. For example, based on the variation of pathways that clearinghouse 1 is able to receive information, a system user transmits geospatial location information including date and time to clearinghouse 1. As one example of transmission of specific information, location information from the offender 5 may be wirelessly transmitted through an offender tracking device 20 and be received by the clearinghouse 1 as GPS coordinates of 38°24'19.45" N 122°6'2.34" W with a date and time of Sep. 23, 2011 16:41:28. Information from the subscriber 6 may be wirelessly transmitted through the subscriber tracking device 7, 8, 9 and be received in the clearinghouse 1 as GPS coordinates 38°25.380' N 122°6.140' W with a date and time of Sep. 23, 2011 4:41:28 PM. In step 520, clearinghouse 1 through the use of business logic services 230 converts the offender 5 information into a homogenized format. The first offender 5 GPS information is formatted from degrees-minutes-seconds to degrees-decimal minutes via the geospatial information server 28. The second offender 5 date information is formatted from middle to big endian form and time information is formatted from the 12-hour to the 24-hour clock. The first offender 5 information becomes 38°24.324' N 122°6.039' W with a date and time of Sep. 23, 2011 16:41:28. The second offender 5 information becomes 38°25.380' N 122°6.140' W with a date and time of Sep. 23, 2011 16:41:28.

Homogenous information conversion within clearinghouse 1 may occur on single or multiple portions of the received information including but not limited to: geospatial, time and date, demographic, criminal records, and sentence guidelines. Conversion may be accomplished through multiple format variations such as text to text, number to text, text to number, or embedded text in an image to text. Variations and permutations will be apparent to one of skill in the art. Converted information is stored in clustered and federated databases 37 as defined in FIG. 2 for further analysis.

In step 530, clearinghouse 1 analyzes and compares homogenous information through the use of the tiered server architecture. Business logic services 230 and the clustered and federated database servers 37 as described in FIG. 2 provide reliable and optimal assessment of homogenous information based upon user or system specific application procedures. As was captured in step 510, offender 5 or other user location, sentence guidelines, criminal record, demographic, and notification procedures are received by clearinghouse 1. Real-time or historic offender 5 information is compared against defined user interface requests as received by supervising agencies 3, contracted companies 4, or subscribers 6 to detect offender 5 violations with respect to trends. For example, a supervising agency 3 may define and transmit a user interface request to clearinghouse 1 based on a sentence that an offender 5 may not repeatedly be in a predefined proximity to a particular geographic location. The geospatial location may be identified as the coordinates where the subscriber frequents such as a house or office. Geospatial location variations will be apparent to one of skill in the art. Clearinghouse 1 accesses and analyzes received offender 5 location and movement in relation to a particular geospatial location. Analysis may be graphical where overlay images of the offender 5 and the geospatial locations are compared. When the offender 5 repeatedly enters a predefined proximity of a particular geospatial location, clearinghouse 1 will respond with notification as outlined in step 540. As another example, offender 5 location and movement information may also be compared against the geospatial locations where criminal activity has previously occurred. Geospatial locations related to previous criminal activity are received by clearinghouse 1, during step 510, by a supervising agency 3, contracted company 4, law enforcement 14, 15 or the subscriber 6. Comparison of offender 5 location and movement frequency at or near the geospatial locations where a previous criminal activity has occurred may be used to predict potential future criminal activity. Geospatial locations where previous criminal activity has occurred may also be directly compared to the location of offender 5 and stored to predict future criminal activity. Variations of comparing multiple geospatial locations where previous criminal activity has occurred will be apparent to one of skill in the art. Offender 5 geospatial location proximity violations and trends may be detected in real-time or after time has elapsed from an occurrence as analyzed information is stored for retrieval in the clustered and federated database servers 37 as defined in FIG. 2. Sentencing guidelines or other offender 5 restrictions are not limited specifically to distance from a user and analysis may be graphical, textual, or tabular. Analytical variations will be apparent to one of skill in the art.

Based upon analytical conditions and results, clearinghouse 1 provides trend notification to system users as shown in step 540. Included with the trend notification, Clearinghouse 1 analyzes and designates an offender 5 threat assessment level. Threat assessment levels are specifically connected to the offender 5 and numerically associate and assign a perceived harm indicator based upon the current geospatial location information and trending patterns in relation to the subscriber 6 or other system user. In general, a threat assessment level will be assigned to an offender 5 based upon a set of rules that determine whether repeated or predicted patterns are occurring that violate sentencing guidelines and/or place the subscriber 6 in a position of perceived or direct harm. Threat assessment levels are defined as increasing magnitudes of severity with Level 0 as the least severe and Level 2 as the most severe case. Clearinghouse 1 may also assign two threat assessment levels where one designates a perceived minimal threat and the other represents a maximum threat to the subscriber 6 or other system user. Threat assessment levels could be assigned any number arranged in increasing order and permutations such as threat assessment levels 1 through 3 or level X through Z and would be apparent to one of skill in the art. Typically, offenders 5 in Clearinghouse 1 are initially assigned a threat assessment level of 0. A threat assessment level of 0 may indicate that there is no relation between the current movement and trending patterns of offender 5 with respect to subscriber 6. A threat assessment level of 1 may indicate common movement and trends and will generate notification directly to subscriber 6. Level 2 may indicate repeated and stalking movement and trends will generate notification to subscriber 6 and law enforcement 14, 15. As trending information is collected and geospatial location information, including date and time, are compared between the offender 5 and the subscriber 6, Clearinghouse 1 will update the threat assessment level. Threat assessment level is dependent upon movement in and out of inclusion or exclusion zones, recurring and persistent proximity to the subscriber 6 or other system user, or if multiple offenders 5 are congregating in repeated or off-limit locations. Where off-limit locations are defined as previous locations were criminal activity occurred or areas that another crime could occur such as school bus stops or parks. As offender 5 threat level assessments increment in severity, Clearinghouse 1 will transmit notification messages to subscriber 6, law enforcement 14, 15, and/or other system user that offender 5 is a perceived threat to subscriber 6 whereby increasing alertness and cautiousness. As an example, offender 5 has been designated as threat assessment level 0 in Clearinghouse 1 and has sentencing guidelines to be at least 50 meters away from subscriber 6. As the offender 5 and subscriber 6 devices transmit geospatial location information, including date and time, Clearinghouse 1 determines based on trending that offender 5 has been outside of 50 meters from subscriber 6, but has been following subscriber 6 on an hourly basis. Clearinghouse 1 will increment the threat assessment level from 0 to 1 and will transmit a notification message to the subscriber 6 or other system user device 7, 8, 9. Subscriber 6 on the subscriber user interface 300 will review the notification and see the threat assessment level indicator on the offender 5 icon 341 within the overlay map 340 as defined in FIG. 3. Concurrently filed application entitled "Released Offender Geospatial Location Information User Application", U.S. Ser. No. 61/584,081 discusses user interface threat level designation in greater detail and is incorporated by reference herein. Notification will alert the subscriber 6 of the perceived threat and if at any point the threat assessment level is elevated from 1 to 2, law enforcement 14, 15 will be directly connected by Clearinghouse 1 for additional support. Supervising agencies 3, contracted companies 4, law enforcement personnel 14, 15 and vehicles 16, and subscribers receive information related to violations from clearinghouse 1 in the form of notifications and reports. Violations may be defined by system users as real-time offender 5 criminal activity or trend reports that describe criminal historic behavior or suspected activities. Notifications may be transmitted in real-time or are sent when requested by system users. Upon meeting the conditions of a violation that are received, converted, and defined by a supervising agency 3, contracted company 4, law enforcement personnel 14, 15, or subscriber 6, clearinghouse 1 transmits a notification to a system user via processes outlined in the business logic service 230 in FIG. 2. For example, subscriber 6 transmits information to clearinghouse 1 to be notified of location, criminal record, threat assessment level, and demographic details when offender 5 has repeatedly been in predefined proximity of a particular geospatial location. Upon analysis and determining that offender 5 is repeatedly visiting a particular geospatial location, clearinghouse 1 transmits an email notification to subscriber cellular phone 8 that contains offender 5 identification information including name and criminal record as well as trend or movement of offender 5. As another example, notifications may be sent to supervising agency 3, contracted companies 4, and law enforcement 14, 15 that predict when an event related to criminal activity will occur. Repeated offender 5 visits to a geospatial location where previous criminal activity has occurred will generate a trend report that the visit is predicted to occur again. Supervising agencies 3, contracted companies 4, and law enforcement 14, 15 may also receive notification of trends and movement. Notification messages may be transmitted in predefined time periods such as less than one minute from determining an offender 5 is within predefined proximity to subscriber 6 or if offender 5 and subscriber 6 are predicted to be in a trend. Trend analysis and report notifications may also be transmitted on a recurring schedule basis such as every 24 hours. Variations of the time periods will be apparent to one of skill in the art.

Notifications may be transmitted directly to the subscriber tracking device 7, 8, 9 in textual format via SMS or email, graphically as maps or overlay images, streaming media by voice or video chatting, or through other communication conduits apparent to one of skill in the art. Violation information may he transmitted to supervising agencies 3, contracted companies 4, law enforcement personnel 14, 15 and vehicles 16 directly through the clearinghouse 1 via the internet 2 or telephone correspondence. Notifications may consist of offender 5 location, criminal record or activity, sentencing guidelines, or other demographic information as specific or requested. Notification messages may also consist of threat alerts based upon trend determination. Variation and permutations of notification format will be apparent to one of skill in the art. Clearinghouse 1 enables multiple supervising agencies 3, contracted companies 4, or law enforcement personnel 14, 15 connected to clearinghouse 1 to share information including violations and notifications among other criminal justice or law enforcement agencies and companies.

Notifications may also be sent to law enforcement personnel 15 or vehicles 16 near the location of the offender 5 violation for assessment. For example, clearinghouse 1 reports a violation on offender 5 based upon supervising agency 3 received information. Contained within the received information is instruction to notify law enforcement when the defined violation occurs. Clearinghouse 1 will determine and compare the location of offender 5 with law enforcement personnel 15 or vehicles 16. Notification will be transmitted to law enforcement personnel 15 or vehicles 16 that are closest to offender 5 through text message, email, or voice. As another example, clearinghouse 1 will transmit notifications to supervising agencies 3, contracted companies 4, and law enforcement 14, 15 when criminal activity is predicted to occur. If an offender 5 repeatedly has been or repeatedly is in proximity to a geospatial location where previous criminal activity has occurred, notification will be sent that the event is predicted to occur again. Notifications may be transmitted to the closest law enforcement 15 and vehicles 16 and to supervising agency 3 and/or contracted company 4.

FIG. 6 represents an exemplary work flow 600 of offender 5 proximity and trend activity analysis provided by clearinghouse 1 as shown in FIG. 1. The process outlined in FIG. 6 outlines an exemplary path through the tiered, clustered, and federated sub-networks 22, 26, 36 as identified in FIG. 2 in which a clearinghouse interacts with data, individuals, and devices. Permutations on these examples and the incorporation of evolving technology will be apparent to one of skill in the art upon reading the present disclosure. Not all steps may be required and in some instances, additional steps not illustrated in FIG. 6 may be performed by clearinghouse 1. Among other functions, clearinghouse 1 can receive, convert, analyze, store, notify, report, and overlay geospatial location and other defined information including: criminal records, demographic information, and sentence guidelines. Inclusion of other information will be apparent to one of skill in the art.

As shown in step 610 of FIG. 6, clearinghouse 1 first receives offender 5 or other user location information. Other users include, but are not limited to: subscribers 6 and law enforcement personnel 14, 15 and vehicles 16. Such information can be geospatial information also including time and date. Depending on the monitoring device used by the offender or the user providing data to clearinghouse 1, clearinghouse 1 may receive data in different ways. For example, if an offender is wearing a criminal offender tracking device 20 with GPS and communication capabilities, the criminal offender tracking device 20 may be configured to connect directly to the clearinghouse 1. In such a situation, the device may transmit real time or historic geospatial information, including date and time, to the clearinghouse 1 via a wired or wireless connection. If an offender 5 is wearing a criminal offender tracking device 20 with GPS capabilities, but is not connected to the clearinghouse, a supervisory agency 3 or contracted company 4 receiving data including geospatial location information from the criminal offender tracking device may transmit the information to the clearinghouse 1 via a wired or wireless connection. The information may be transmitted as historic or in real time. If an offender 5 or user does not have a tracking device with GPS capabilities, the offender may be required to directly inform a supervising agency 3, contracted company 4, or other user of historic or real time geospatial location information, including date and time information. In that instance, the supervising agency 3, contracted company 4, or other user may then provide such information directly to the clearinghouse 1. System users not wearing tracking devices may directly interact with clearinghouse 1 through the use of cellular phones 8, laptop computers 9, personal digital assistants (PDA) 7, or other personal communication devices.

Supervising agencies 3, contracted companies 4, offenders 5, law enforcement 14, 15, and subscribers 6 interact with clearinghouse 1 to create user interface requests. User interface requests indicate how clearinghouse 1 should respond when definition is provided by a supervising agency 3, contracted company 4, law enforcement 14, 15, or subscriber 6. As an example, information may be received from the supervising agency 3, contracted company 4, or law enforcement 14, 15 that clearinghouse 1 should notify the supervising agency 3, contracted company 4, or law enforcement 14, 15 when two offenders 60, 61 who may be monitored by disparate systems interact, move, and are within a predefined proximity to each other. Supervised released offenders 60, 61 are the same supervised offenders 5 referenced in context and other figures of this invention and the number of monitored offenders may be greater than two. One or more locations where criminal activity has occurred may also be received by a supervising agency 3, contracted company 4, and law enforcement 14, 15. Clearinghouse 1 may also receive offender 60, 61 violation and sentencing guidelines and predefined proximity parameters from supervising agencies 3, contracted companies 4, law enforcement 14, 15 or directly from the offender tracking device 20. The clearinghouse 1 will thus be instructed through user interface requests to analyze trends, interaction, and the current movement of multiple offenders 60, 61 to each other and proximity to a multiple locations where criminal activity has occurred. Trend data may be used to predict future offender 5 movements and potential future criminal activity. For example, clearinghouse 1 may be configured to receive offender 5 location information on a continual, time period, basis. The time period is user definable and may be in configured in any combination of days, hours, minutes, and/or seconds. Variation of monitored system user and time period will be apparent to one of skill in the art. Reception of data to clearinghouse 1 may be facilitated via the monitoring of a standard internet service 220 as described in FIG. 2. Subscribers, offenders, or other system users interact with the clearinghouse 1 through standard interact services 220 providing information in various formats (email, telephone, web applications or other file transfer protocols). Received information along with business logic services 230 that manage the standard internet service 220 as defined in FIG. 2 are stored for retrieval, updating, and/or archiving in clearinghouse 1 in clustered and federated database servers 37.

Once clearinghouse 1 receives offender 60, 61 or other user location information as shown in step 610, clearinghouse 1 then converts the received information to a homogenous format as shown in step 620. The process of converting received information into a homogenous format enhances analysis and data comparison as defined in step 430. For example, based on the variation of pathways that clearinghouse 1 is able to receive information, two offenders 60, 61 transmit geospatial location information including date and time to clearinghouse 1. As one example of transmission of specific information, location information from offender 60 may be wirelessly transmitted through an offender tracking device 20 and be received by the clearinghouse 1 as GPS coordinates of 38°24'19.45" N 122°6'2.34" W with a date and time of Sep. 23, 2011 16:41:28. Information from another offender 61 may be wirelessly transmitted through an offender tracking device 20 through a supervising agency 3 and be received in the clearinghouse 1 as GPS coordinates 38°25.380' N 122°6.140' W with a date and time of Sep. 23, 2011 4:41:28 PM. In step 420, clearinghouse 1 through the use of business logic services 230 converts the offender 60, 61 information into a homogenized format. The first offender 60 GPS information is formatted from degrees-minutes-seconds to degrees-decimal minutes via the geospatial information server 28. The second offender 61 date information is formatted from middle to big endian form and time information is formatted from the 12-hour to the 24-hour clock. The first offender 60 information becomes 38°24.324' N 122°6.039' W with a date and time of Sep. 23, 2011 16:41:28. The second offender 61 information becomes 38°25.380' N 122°6.140' W with a date and time of Sep. 23, 16:41:28.

Homogenous information conversion within clearinghouse 1 may occur on single or multiple portions of the received information including but not limited to: geospatial, time and date, demographic, criminal records, and sentence guidelines. Conversion may be accomplished through multiple format variations such as text to text, number to text, text to number, or embedded text in an image to text. Variations and permutations will be apparent to one of skill in the art. Converted information is stored in clustered and federated databases 37 as defined in FIG. 2 for further analysis.

In step 630, clearinghouse 1 analyzes and compares homogenous information through the use of the tiered server architecture. Business logic services 230 and the clustered and federated database servers 37 as mentioned in FIG. 2 provide reliable and optimal assessment of homogenous information based upon user or system specific application procedures. As was captured in step 410, offender 60, 61 or other user location, sentence guidelines, criminal record, demographic, and notification procedures are received by clearinghouse 1. Real-time or historic offender 60, 61 information is compared against defined user interface requests as received by supervising agencies 3, contracted companies 4, or subscribers 6 to detect offender 60, 61 violations with respect to trends. For example, a supervising agency 3 may define and transmit a user interface request to clearinghouse 1 based on a sentence that an offender 60 may be not be within a certain distance e.g., proximity of another offender 61. Clearinghouse 1 analyzes the real time or historic location of offender 60 in relation to the real time or historic location of offender 61 as well as information received regarding sentencing guidelines from a supervising agency 3 or contracted company 4. Trends may also be analyzed relating proximity of offenders 60, 61 to a real time or historic location where criminal activity has occurred. Analysis may be textual or graphical where overlay images of the offender 60 and offender 61 locations or a location where criminal activity has occurred are compared with a predefined distance or time based parameter.

The clearinghouse 1, in 640 of FIG. 6, would determine if the location of the two offenders 60, 61 are common with respect to the predetermined time or distance. Common location may be defined as within proximity based upon time or distance. Offender 60, 61 location may also be compared against an area where criminal activity has occurred. As an example, clearinghouse 1 would receive information from supervising agencies 3, contracted companies 4, or law enforcement 14, 15 to notify when the two offenders 60, 61 are less than or equal to 50 radial meters from each other or when one or multiple offenders 60, 61 are less than 50 radial meters from a location where criminal activity has occurred. In other words, if one offender 60 is considered a point, then clearinghouse 1 will provide notification when the other offender 61 is within a radius of 50 meters from the other. If the two locations are common, notification is sent in 650. If the two locations are not common, clearinghouse 1 will continue to analyze location information as outlined in step 630. Variations of monitoring the trends of multiple offenders with respect to each other or to multiple locations where criminal activity has occurred will be apparent to one of skill in the art.

Based upon analytical conditions and results, clearinghouse 1 provides trend notification to system users as shown in step 650. Supervising agencies 3, contracted companies 4, law enforcement personnel 14, 15 and vehicles 16, and subscribers 6 receive information related to violations from clearinghouse 1 in the form of notifications and reports. Violations may be defined by system users as real-time offender 5 criminal activity or trend reports that describe criminal historic behavior or suspected activities. Notifications may be transmitted in real-time or are sent when requested by system users. Upon meeting the conditions of a violation that are received, converted, and defined by a supervising agency 3, contracted company 4, law enforcement personnel 14, 15, or subscriber 6, clearinghouse 1 transmits a notification to a system user via processes outlined in the business logic service 230 in FIG. 2. For example, supervising agency 3, contracted company 4, or law enforcement 14, 15 transmits information to clearinghouse 1 to be notified of location, criminal record, and demographic details when offender 60 is within a defined distance from offender 61. Upon analysis and determining that offender 60 is within the predefined distance from offender 61, clearinghouse 1 transmits an email notification to supervising agency 3, contracted company 4, or law enforcement 14, 15 that contains the offenders 60, 61 identification information including name and criminal record as well as location of offenders 60, 61. As another example, notifications may be sent to supervising agencies 3, contracted companies 4, and law enforcement 14, 15 that predict when an event related to criminal activity will occur. Repeated offender 60 to offender 61 proximity violations will generate a trend report that the interaction is predicted to occur again. Notification messages may be transmitted in predefined time periods such as less than one minute from determining an offender 60 is within proximity to offender 61 or if offender 60 and offender 61 are predicted to be in a trend. Notifications may also be transmitted on a recurring schedule basis such as every 24 hours. Variations of the time periods will be apparent to one of skill in the art.

Notifications may be transmitted directly to the subscriber tracking device 7, 8, 9 in textual format via SMS or email, graphically as maps or overlay images, streaming media by voice or video chatting, or through other communication conduits apparent to one of skill in the art. Violation information may be transmitted to supervising agencies 3, contracted companies 4, law enforcement personnel 14, 15 and vehicles 16 directly through the clearinghouse 1 via the internet 2 or telephone correspondence. Notifications may consist of offenders 60, 61 location, criminal record or activity, sentencing guidelines, location where criminal activity has occurred, or other demographic information as specific or requested. Notification messages may also consist of threat alerts based upon trend determination. Variation and permutations of notification format will be apparent to one of skill in the art. Clearinghouse 1 enables multiple supervising agencies 3, contracted companies 4, or law enforcement personnel 14, 15 connected to clearinghouse 1 to share information including violations and notifications among other criminal justice or law enforcement agencies and companies.

Notifications may also be sent to law enforcement personnel 15 or vehicles 16 near the location of the offenders 60, 61 proximity violations for assessment. For example, clearinghouse 1 reports a violation on offender 5 based upon supervising agency 3 received information. Contained within the received information is instruction to notify law enforcement when the defined violation occurs. Clearinghouse 1 will determine and compare the location of offender 60, 61 with law enforcement personnel 15 or vehicles 16. Notification will be transmitted to law enforcement personnel 15 or vehicles 16 that are closest to offender 60, 61 through text message, email, or voice. If an offender 60 repeatedly has been or repeatedly is in proximity to offender 61, notification will be sent that the event is predicted to occur again. Notifications may be transmitted to the closest law enforcement 15 and vehicles 16 and to supervising agency 3 and/or contracted company 4.

FIG. 7 represents an exemplary work flow 700 of offender 5 to subscriber 6 trend activity analysis provided by clearinghouse 1 as shown in FIG. 1. The process outlined in FIG. 7 outlines an exemplary path through the tiered, clustered, and federated sub-networks 22, 26, 36 as identified in FIG. 2 in which a clearinghouse interacts with data, individuals, and devices. Permutations on these examples and the incorporation of evolving technology will be apparent to one of skill in the art upon reading the present disclosure. Not all steps may be required and in some instances, additional steps not illustrated in FIG. 5 may be performed by clearinghouse 1. Among other functions, clearinghouse 1 can receive, convert, analyze, store, notify, report, and overlay geospatial location and other defined information including: criminal records, demographic information, and sentence guidelines. Inclusion of other information will be apparent to one of skill in the art.

In step 710 of FIG. 7, clearinghouse 1 first receives a predefined proximity time period and/or a distance parameter from a system user through wired or wireless connections. As an example, information in the form of time periods and distance parameters may be received by clearinghouse 1 from the subscriber 6 as how often during a defined time period e.g., 24 hours an offender has been in proximity with subscriber 6. The subscriber may also define when the offender was within a defined distance e.g., 50 meters of the subscriber 6. Multiple time periods or distance parameters may also be defined by the system user and variations or combinations will be apparent to one of skill in the art.

As shown in step 720 of FIG. 7, clearinghouse 1 receives offender 5 or other user location information. Other users include, but are not limited to: subscribers 6 and law enforcement personnel 14, 15 and vehicles 16. Such information can be geospatial information also including time and date. Depending on the monitoring device used by the offender or the user providing data to clearinghouse 1, clearinghouse 1 may receive data in different ways. For example, if an offender is wearing a criminal offender tracking device 20 with GPS and communication capabilities, the criminal offender tracking device 20 may be configured to connect directly to the clearinghouse 1. In such a situation, the device may transmit real time or historic geospatial information, including date and time, to the clearinghouse 1 via a wired or wireless connection. If an offender 5 is wearing a criminal offender tracking device 20 with GPS capabilities, but is not connected to the clearinghouse, a supervisory agency 3 or contracted company 4 receiving data including geospatial location information from the criminal offender tracking device may transmit the information to the clearinghouse 1 via a wired or wireless connection. The information may be transmitted as historic or in real time. If an offender 5 or user does not have a tracking device with GPS capabilities, the offender may be required to directly inform a supervising agency 3, contracted company 4, or other user of historic or real time geospatial location information, including date and time information. In that instance, the supervising agency 3, contracted company 4, or other user may then provide such information directly to the clearinghouse 1. System users not wearing tracking devices may directly interact with clearinghouse 1 through the use of cellular phones 8, laptop computers 9, personal digital assistants (PDA) 7, or other personal communication devices.

Supervising agencies 3, contracted companies 4, offenders 5, law enforcement 14, 15, and subscribers 6 interact with clearinghouse 1 to create user interface requests. User interface requests indicate how clearinghouse 1 should respond when definition is provided by a supervising agency 3, contracted company 4, law enforcement 14, 15, or subscriber 6. As an example, information may be received from the subscriber 6 that clearinghouse 1 should notify the subscriber 6 when an offender 5 has been in predefined proximity of the subscriber 6 or is within a predefined proximity of subscriber 6. Clearinghouse 1 may also receive offender 5 violation and sentencing guidelines from supervising agencies 3, contracted companies 4, law enforcement 14, 15 or directly from the offender tracking device 20. The clearinghouse 1 will thus be instructed through user interface requests to analyze trends, interaction, and the current movement of the offender 5 in relation to subscriber 6 movements and location. Trend data may be used to predict future offender 5 movements and potential future criminal activity. For example, clearinghouse 1 may be configured to receive offender 5 location information on a continual, time period, basis. The time period is user definable and may be in configured in any combination of days, hours, minutes, and/or seconds. Variation of monitored system user and time period will be apparent to one of skill in the art. Reception of data to clearinghouse 1 may be facilitated via the monitoring of a standard internet service 220 as described in FIG. 2. Subscribers, offenders, or other system users interact with the clearinghouse 1 through standard internet services 220 providing information in various formats (email, telephone, web applications or other file transfer protocols). Received information along with business logic services 230 that manage the standard internet service 220 as defined in FIG. 2 are stored for retrieval, updating, and/or archiving in clearinghouse 1 in clustered and federated database servers 37.

Once clearinghouse 1 receives offender 5 or other user location information as shown in step 720, clearinghouse 1 then converts the received information to a homogenous format as shown in step 730. The process of converting received information into a homogenous format enhances analysis and data comparison as defined in step 740. For example, based on the variation of pathways that clearinghouse 1 is able to receive information, offender 5 geospatial location information including date and time is received by clearinghouse 1. As one example of transmission of specific information, location information from offender 5 may be wirelessly transmitted through an offender tracking device 20 and be received by the clearinghouse 1 as GPS coordinates of 38°24'19.45" N 122°6'2.34" W with a date and time of Sep. 23, 2011 16:41:28. Information from the subscriber 6 may be wirelessly transmitted through the subscriber tracking device 7, 8, 9 and be received in the clearinghouse 1 as UPS coordinates 38°25.380' N 122°6.140' W with a date and time of Sep. 23, 2011 4:41:28 PM. In step 530, clearinghouse 1 through the use of business logic services 230 converts the offender 5 and subscriber 6 location information into a homogenized format. The offender 5 GPS information is formatted from degrees-minutes-seconds to degrees-decimal minutes via the geospatial information server 28. The subscriber 6 date information is formatted from middle to big endian form and time information is formatted from the 12-hour to the 24-hour clock. The offender 5 information becomes 38°24.324' N 122°6.039' W with a date and time of Sep. 23, 2011 16:41:28. The subscriber 6 information becomes 38°25.380' N 122°6.140' W with a date and time of Sep. 23, 2011 16:41:28.

Homogenous information conversion within clearinghouse 1 may occur on single or multiple portions of the received information including but not limited to: geospatial, time and date, demographic, criminal records, and sentence guidelines. Conversion may be accomplished through multiple format variations such as text to text, number to text, text to number, or embedded text in an image to text. Variations and permutations will be apparent to one of skill in the art. Converted information is stored in clustered and federated databases 37 as defined in FIG. 2 for further analysis.

In step 740, clearinghouse 1 analyzes and compares homogenous information through the use of the tiered server architecture. Business logic services 230 and the clustered and federated database servers 37 as mentioned in FIG. 2 provide reliable and optimal assessment of homogenous information based upon user or system specific application procedures. As was captured in step 720, offender 5 or other user location, sentence guidelines, criminal record, demographic, and notification procedures are received by clearinghouse 1. Real-time or historic offender 5 information is compared against defined user interface requests as received by supervising agencies 3, contracted companies 4, or subscribers 6 to detect offender 5 violations with respect to trends. For example, the subscriber 6 may define and transmit a user interface request to clearinghouse 1 to notify the subscriber when an offender 5 has been in a predefined proximity to the subscriber 6 or is in a predefined proximity to the subscriber 6. Clearinghouse 1 analyzes the real time or historic location and movement of the offender 5 in relation to the real time or historic location and movement of the subscriber as well as information received regarding sentencing guidelines from a supervising agency 3 or contracted company 4. As a further example, if offender 5 sentence information includes a history of crime directed towards young women and the subscriber 6 demographic information indicates that the subscriber 6 is a young woman, clearinghouse 1 will monitor location information of offender 5 in relation to subscriber 6. The application servers 31 as defined in FIG. 2 will look for the same subscriber 6 and the same offenders 5 at other geospatial locations, including date and time, and indicate a trend of the offender 5 and subscriber 6. Movement history will also be examined to determine if the supervised released criminal offender 5 movement follows or parallels the movement history of the subscriber 6. Analysis may be textual or graphical where overlay images of the offender 5 and subscriber 6 locations are compared with a predefined distance or time based parameter.

The clearinghouse 1, in 750 of FIG. 7, would determine if the locations of the offender 5 and the subscriber 6 have been or are common with respect to the predetermined time or distance received in step 710. Common location may be defined as within proximity based upon time or distance. As an example, clearinghouse 1 would receive information from the subscriber 6 to notify when the offender 5 has previously been less than or equal to 50 radial meters from the subscriber 6 or when the offender 5 is less than 50 radial meters from the subscriber 6. In other words, if the subscriber 6 is considered a point, then clearinghouse 1 will provide notification when the offender 5 has been within a radius of 50 meters from subscriber 6 or is currently within a radius of 50 meters from the subscriber 6. If the two locations have been or are common, notification is sent in 560. If the two locations are not common, clearinghouse 1 will continue to analyze location information as outlined in step 540. Variations of monitoring the trends of multiple offenders with respect to the subscriber 6 will be apparent to one of skill in the art.

Based upon analytical conditions and results, clearinghouse 1 provides trend notification to system users as shown in step 760. Supervising agencies 3, contracted companies 4, law enforcement personnel 14, 15 and vehicles 16, E911 dispatch 70, chat operators 71, parole officers 100, and/or probation and parole officers at supervising agencies 100 and subscribers 6 receive information related to violations from clearinghouse 1 in the form of notifications and reports. Violations may be defined by system users as real-time offender 5 criminal activity or trend reports that describe criminal historic behavior or suspected activities. Notifications may be transmitted in real-time or are sent when requested by system users. Upon meeting the conditions of a violation that are received, converted, and defined by a supervising agency 3, contracted company 4, law enforcement personnel 14, 15, or subscriber 6, clearinghouse 1 transmits a notification to a system user via processes outlined in the business logic service 230 in FIG. 2. For example, subscriber 6 is notified of location, criminal record, and demographic details when offender 5 has been in a predefined proximity from subscriber 6 or is in a predefined proximity from subscriber 6. Upon analysis and determining that offender 5 has been in a predefined proximity from subscriber 6 or is in a predefined proximity from subscriber 6, clearinghouse 1 transmits an email notification to subscriber 6 that contains the offender 5 identification information including name and criminal record as well as location. As another example, notifications may be sent to supervising agencies 3, contracted companies 4, and law enforcement 14, 15 that predict when an event related to criminal activity will occur. Repeated offender 5 to subscriber 6 proximity violations will generate a trend report that the interaction is predicted to occur again. As a further example, confirmation of a trend behavior of the offender 5 following or paralleling the movements of the subscriber 6 will result in trend reports being sent to the supervising agency 3 indicating an elevated threat to the subscriber 6. Notifications will also be sent to the subscriber 6 with offender 5 geospatial location, including date and time, and demographic data. Notification messages may be transmitted in predefined time periods such as less than one minute from determining an offender 5 has been or is within a predefined proximity to subscriber 6 or if offender 5 and subscriber 6 are predicted to be in a trend. Notifications may also be transmitted on a recurring schedule basis such as every 24 hours. Variations of the time periods will be apparent to one of skill in the art.

Notifications may be transmitted directly to the subscriber tracking device 7, 8, 9 in textual format via SMS or email, graphically as maps or overlay images, streaming media by voice or video chatting, or through other communication conduits apparent to one of skill in the art. Violation information may be transmitted to supervising agencies 3, contracted companies 4, law enforcement personnel 14, 15 and vehicles 16, E911 dispatch 70, chat operators 71, parole officers 100, and/or probation and parole officers at supervising agencies 100 directly through the clearinghouse 1 via the internet 2 or telephone correspondence. Notifications may consist of offender 5 location, criminal record or activity, sentencing guidelines, location where criminal activity has occurred, or other demographic information as specific or requested. Notification messages may also consist of threat alerts based upon trend determination. Variation and permutations of notification format wilt be apparent to one of skill in the art. Clearinghouse 1 enables multiple supervising agencies 3, contracted companies 4, or law enforcement personnel 14, 15 connected to clearinghouse 1 to share information including violations and notifications among other criminal justice or law enforcement agencies and companies.

Notifications may also be sent to law enforcement personnel 15 or vehicles 16 near the location of the offender 5 and subscriber 6 predefined proximity violations for assessment. For example, clearinghouse 1 reports a violation on offender 5 based upon supervising agency 3 received information. Contained within the received information is instruction to notify law enforcement when the defined violation occurs. Clearinghouse 1 will determine and compare the location of offender 5 and subscriber 6 with law enforcement personnel 15 or vehicles 16. Notification will be transmitted to law enforcement personnel 15 or vehicles 16 that are closest to offender 5 through text message, email, or voice. If an offender 5 repeatedly has been or repeatedly is in proximity to subscriber 6, notification will be sent that the event is predicted to occur again. Notifications may be transmitted to the closest law enforcement 15 and vehicles 16 and to supervising agency 3 and/or contracted company 4.

Although the present disclosure has been described with reference to preferred embodiments, those of skill in the art will recognize that changes may be made in form and detail without departing from the spirit and scope of the present disclosure.

What is claimed is:

1. A method of trend analysis for information related to released criminal offenders, the method comprising:

(a) accessing, with a computer system, geospatial location information including date and time information for released criminal offenders;

(b) identifying, with a computer system and based at least in part on first location information received via communication with monitoring devices of the released criminal offenders, repeated visits by one of the released criminal offenders within a defined proximity of a particular geospatial location;

(c) assigning, with a computer system, a threat level to the released criminal offender based on the frequency of the repeated visits;

(d) monitoring, with a computer system and based at least in part on second location information received via communication with the monitoring devices of the released criminal offenders, activity of the released criminal offender and changing the assigned threat level based on the activity of the released criminal offender; and (e) providing, with a computer system, a notification to a user when the assigned threat level increases.

2. The method of claim 1, further comprising predicting an event related to criminal activity, the predicting based on identification of repeated visits by the released criminal offender within defined proximity of a particular geospatial location.

3. A method of trend analysis for information related to released criminal offenders, the method comprising:

(a) accessing, with a computer system, geospatial location information including date and time information for released criminal offenders;

(b) identifying, with a computer system and based at least in part on the geospatial location information received via communication with monitoring devices of the released criminal offenders, a movement pattern indicative of repetitive behavior, such movement pattern including visits to multiple separate locations, of one of the released criminal offenders; and (c) assigning, with a computer system, a threat level to the released criminal offender based on the movement pattern indicative of repetitive behavior of one of the released criminal offenders.

4. The method of claim 1 or 3, further comprising comparing information about a location surrounding the released criminal offender to information related to previous criminal activity.

5. The method of claim 1 or 3, further comprising identifying when the released offender is within a defined proximity of a second released offender.

6. A method of trend analysis for information related to released criminal offenders, the method comprising:

(a) accessing, with a computer system, geospatial location information including date and time information for released criminal offenders, wherein the geospatial location information received via communication with monitoring devices of the released criminal offenders;

(b) comparing, with a computer system, the movements of one the released criminal offenders to the movements of a subscriber; and identifying a correlation between the movements of one of the released criminal offenders and the subscriber; and (c) assigning, with a computer system, a threat level to the released criminal offender based on the correlation between the movements of one of the released criminal offenders and the subscriber.

7. The method of claim 1, 3 or 6, further comprising reporting the trend analysis to a supervising agency.

8. The method of claim 1, 3 or 6, further comprising making results of the trend analysis available to a subscriber.

9. The method of claim 6, further comprising notifying a subscriber within a defined proximity of the released offender based on results of the trend analysis.

10. The method of claim 6, wherein the trend analysis is performed based on a request by a subscriber.

11. The method of claim 1, 3 or 6, further comprising notifying a criminal justice agency of the results of the trend analysis.

* * * * *